United States Patent [19]

Thornburg

[11] 4,064,822

[45] Dec. 27, 1977

[54] SELF-CONTAINED MOORING SYSTEM FOR A DRILL SHIP

[75] Inventor: Russell B. Thornburg, Beverly Hills, Calif.

[73] Assignee: Global Marine, Inc., Los Angeles, Calif.

[21] Appl. No.: 724,274

[22] Filed: Sept. 20, 1976

[51] Int. Cl.[2] ..... B63B 21/16

[52] U.S. Cl. ..... 114/230; 114/264

[58] Field of Search ..... 114/144 B, 230, 258, 114/264, 265, 293; 9/8 P

[56] References Cited

U.S. PATENT DOCUMENTS

| | | | |
|---|---|---|---|
| 3,191,201 | 6/1965 | Richardson et al. | 114/144 B |
| 3,279,404 | 10/1966 | Richardson | 114/293 |
| 3,440,671 | 4/1969 | Smulders | 114/230 |
| 3,760,875 | 9/1973 | Busking | 114/264 |
| 3,774,562 | 11/1973 | Dean | 114/293 |

*Primary Examiner*—George E. A. Halvosa
*Assistant Examiner*—Stuart M. Goldstein
*Attorney, Agent, or Firm*—Christie, Parker & Hale

[57] ABSTRACT

A mooring system for a drill ship has an annular cell mounted in the bottom of the hull concentrically around the moon pool. A plurality of annular cable drums are rotatable within the cell, the drums and the cell being rotatable about a common vertical axis. Anchor cables wound on the respective drums are directed by sheaves through the bottom of the cell through an opening in the bottom of the hull to anchors on the ocean floor for anchoring the vessel over a drill site. The drums are individually driven to adjust the associated cable, while the entire cell together with the drums is rotated within the hull to change the heading of the vessel relative to the anchors.

9 Claims, 5 Drawing Figures

SELF-CONTAINED MOORING SYSTEM FOR A DRILL SHIP

FIELD OF THE INVENTION

This invention relates to a mooring system for floating vessel such as a drill ship, and more particularly, to a mooring system which allows the vessel to change heading while the vessel remains essentially stationary over its mooring.

BACKGROUND OF THE INVENTION

Various arrangements have heretofore been proposed for anchoring a drill ship during drilling operations at sea. One arrangement heretofore proposed utilizes a rotating turret from which a plurality of anchor cables extend to widely spaced anchor points on the ocean floor. The turret is rotatable with respect to the ship so that the turret can be held by the anchors over a drilling location while the heading of the ship can be changed by rotating the vessel relative to the turret. By carrying on drilling through the center of the turret, the heading of the ship can be changed without interrupting the drilling operations. The turret type mooring system is described, for example, in U.S. Pat. Nos. 3,191,201 and 3,279,404.

To provide adequate mooring, it is general practice to use as many as eight anchors spaced in a wide circle around the drill site on the ocean floor. Cables from each of the anchors are brought up into the turret and directed onto suitable winches having drums on which the respective cables are wound. The winches and associated drums must be mounted on the turret structure so as to remain in fixed relation to the turret while allowing the ship to rotate freely about the axis of the turret. To provide room for the winches and cable storing drums, the turret structure is extended to the main deck, the top of the turret being provided with a large platform at the level of the main deck which rotates with the turret and on which the winches and cables drums are mounted. This arrangement has the disadvantages that it occupies valuable space on the main deck, interferes with movement of equipment (BOP stacks, etc.) into the center well (moonpool), and requires that the drilling platform be raised to provide necessary clearance to the main deck. This latter in turn can adversely affect the transverse stability of the vessel by raising the center of gravity relative to center of buoyancy.

SUMMARY OF THE INVENTION

The present invention is directed to an improved mooring system which is self-contained within the hull below the deck of the drilling vessel. The anchor cables of the mooring system extend outwardly from the bottom of the vessel, the cables where they pass through the bottom of the vessel being spaced around a circle which can be disposed concentric with a central drilling well where the mooring system is located amidships on a drill ship. The vessel is rotatable through 360° relative to the mooring system. This is accomplished by providing an annular hollow cell which is rotatably mounted in the interior of the vessel with its axis of revolution extending vertically. A plurality of cable drums are rotatably mounted inside the cell, the axis of revolution of the drums being coaxial with the axis of revolution of the cell. Separate drive means drives the cell relative to the vessel and rotates each of the drums individually with respect to the cell. Sheaves within the cell guide the anchor cables from the respective coaxial drums out through the bottom of the cell, the cables exiting out through the bottom of the hull at equally spaced arcuate intervals around the bottom of the cell.

DESCRIPTION OF THE DRAWINGS

For a more complete understanding of the invention reference should be made to the accompanying drawings, wherein.

DETAILED DESCRIPTION

Figure 1:
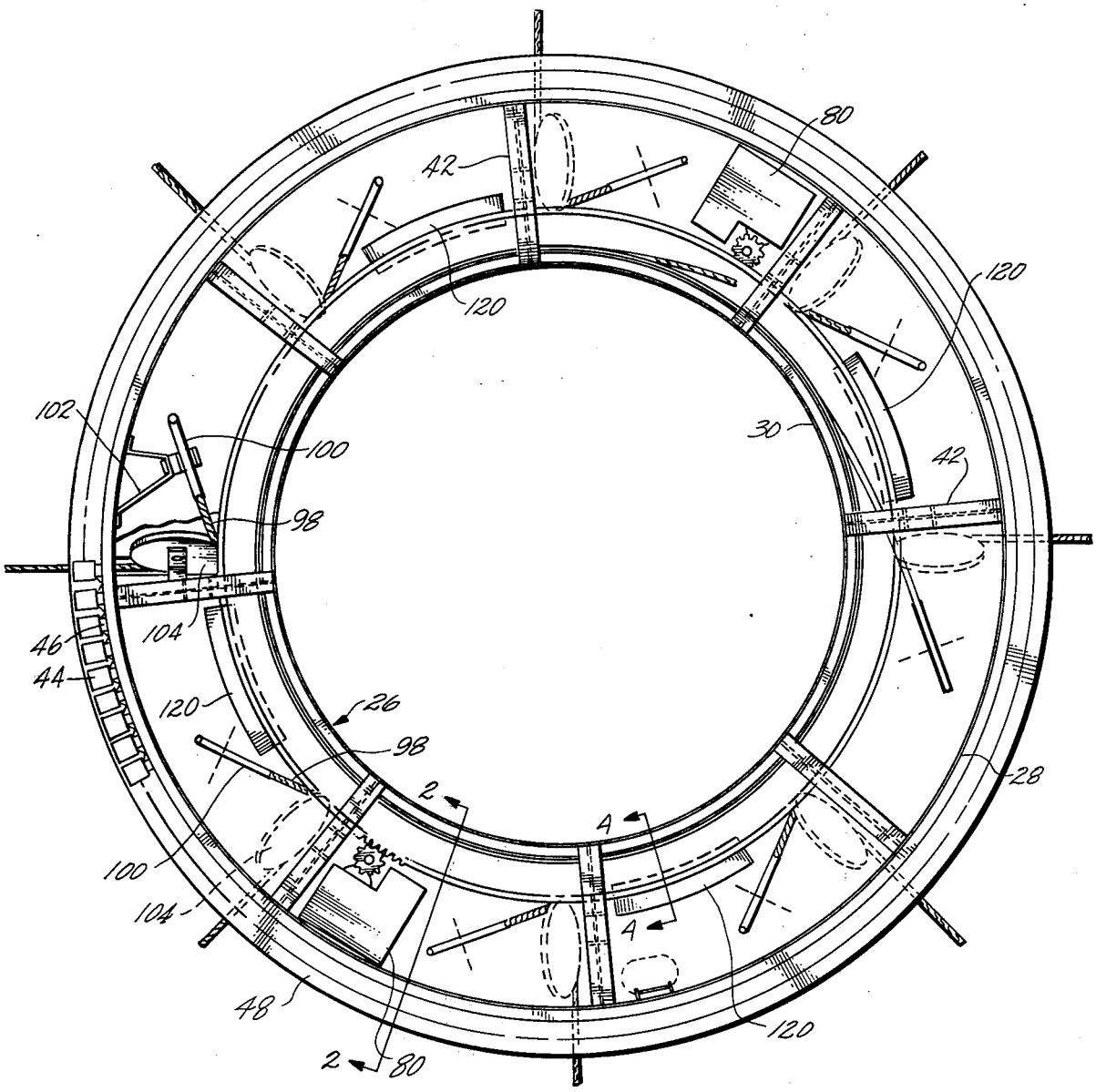
FIG. 1 is a partial plan view partly in section showing the annular cell with the top wall removed.
Figure 2:
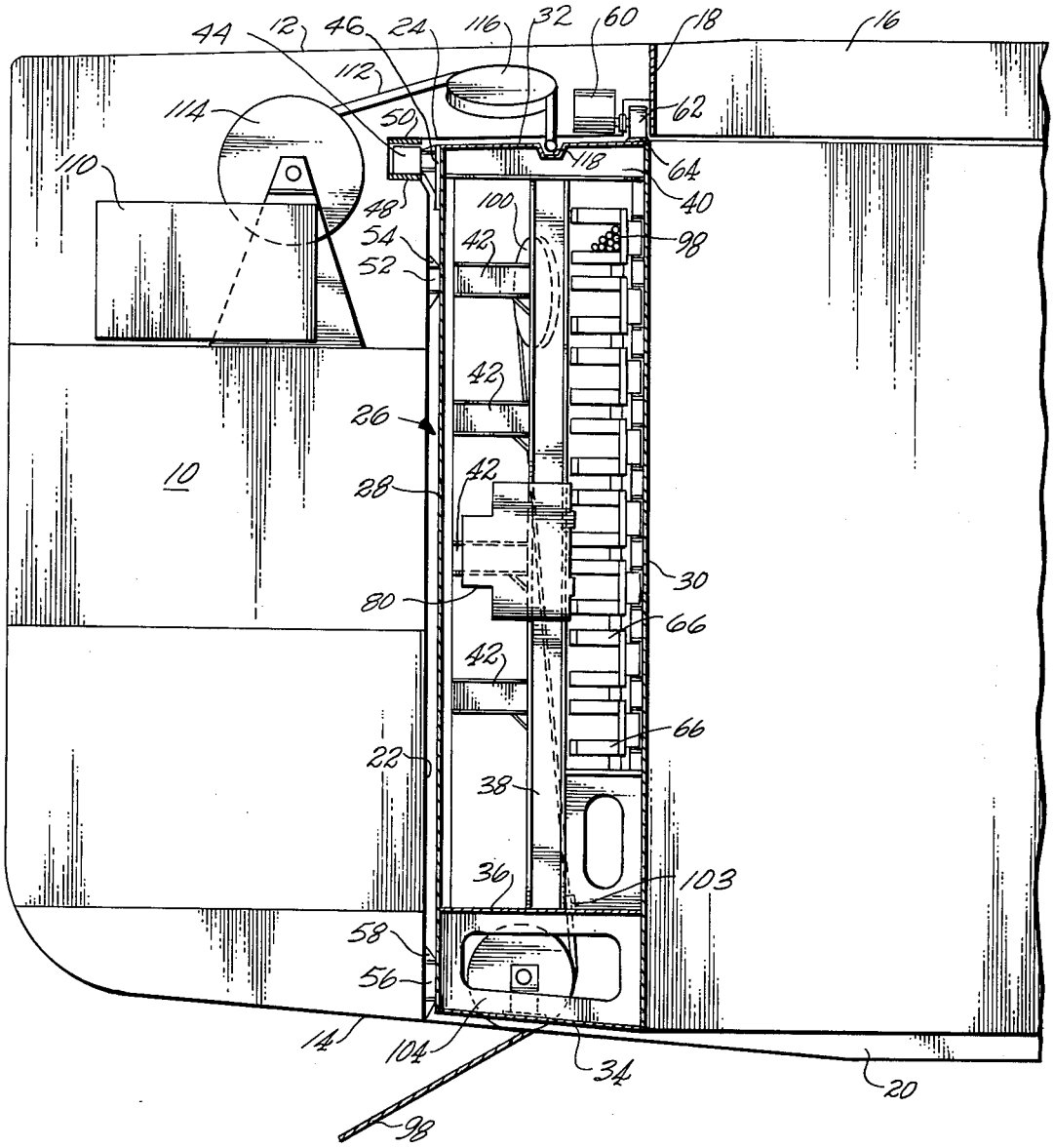
FIG. 2 is a sectional view in elevation taken substantially on the line 2—2 of FIG. 1.

Referring to the drawings in detail, and particularly the embodiment as shown in FIGS. 1–4, the numeral 10 indicates generally the hull of a drill ship of the type conventionally used for offshore drilling on the ocean floor. The hull includes a main deck 12 and a bottom 14. In the conventional drilling ship, the ship is provided with a central amidships well or "moon pool" which extends vertically through the center of the vessel, providing access for a drill string from a drilling rig (not shown) mounted on a platform above the main deck to the ocean floor. In the embodiment shown in FIGS. 1–4 and especially in FIG. 2, the moon pool includes a smaller diameter upper portion 16 providing an opening in the main deck 12, the upper portion of the moon pool having a fixed cylindrical wall 18. A lower portion 20 of the moon pool has a larger diameter and is formed by cylindrical wall 22 extending upwardly from the bottom 14. The walls 18 and 22 are joined by a sub deck 24 within the hulls. The cylindrical walls 18, 22 and sub deck 24 form a watertight well through the ship which is open to the sea through an opening in the bottom 14.

Positioned in the larger diameter portion of the well within the cylindrical wall 22 is a mooring member in the form of an annular cell or structure indicated generally at 26. The annular cell 26 includes an outer cylindrical wall 28 which is coaxial with and is slightly smaller in diameter than the wall 22 of the moon pool. The cell 26 has a concentric cylindrical inner wall 30 which is preferably of the same inner diameter as the wall 18 of the upper portion of the moon pool. The inner and outer sidewalls 28 and 30 are joined by a top wall 32, a bottom wall 34, and an inner bottom wall 36. The walls of the cell are supported by suitable internal bracing including a plurality of vertical beams 38 extending between the top wall 32 and inner bottom wall 36. Radial cross members 40 at the top and intermediate cross members 42 provide rigidity. The side walls 28, 30 and the top wall 32 form a watertight annular compartment within the cell in which air is trapped to control the buoyancy of the cell.

The cell 26 is rotatably supported in the hull by a plurality of closely spaced rollers 44 journaled for rotation about horizontal axes by suitable support member 46 secured to the upper margin of the outer side wall 28. The rollers 44 project radially outwardly between a pair of flat circular guide tracks 48 and 50 positioned in a channel or slot extending around the upper periphery of the sidewall 22 of the hull 10. Thus any upwardly or downwardly directed thrust of the cell relative to the vessel is transferred by the rollers 44 to the tracks 48 or 50. A plurality of outer cell rollers 52, journaled on supporting brackets 54 secured to the hull wall 22, engages the outer wall 28 of the cell 26 near the upper end thereof. Similar guide rollers 56 journaled on brackets 58 are mounted on the hull wall 22 and engage the outer wall 28 of the cell 26 adjacent the lower end thereof. Thus the rollers 52 and 56 maintain the center of the cell concentrically within the moon pool, allowing the annular cell 26 to rotate relative to the vessel about the central vertical axis of the moon pool. All of the rollers are made of an elastomer material to accommodate flexing of the hull. Powered rotation of the cell relative to the vessel is provided by a suitable drive motor 60 mounted above the subdeck 24. The motor drives a pinion 62 that engages a gear rack 64 extending around the inner perimeter of the top wall 32 of the cell 26.

A plurality of annular cable storage and tensioning drums 66, eight of which are shown by way of example, are positioned inside the cell 26. The drums 66 are spaced vertically relative to each other and rotate about a common axis which is the axis of rotation of the cell. As shown in detail in FIGS. 3 and 4, each of the drums 66 is supported on a plurality of horizontal rollers 68. Each of the rollers 68 is journaled on a shaft 70 projecting from a suitable supporting bracket 72 secured to the inner wall 30 of the cell. A plurality of vertical rollers 74 are each journaled on a vertical shaft 76. The shafts 76 are supported at either end by suitable brackets 78 extending outwardly from the inner side wall 30.

Figure 3:
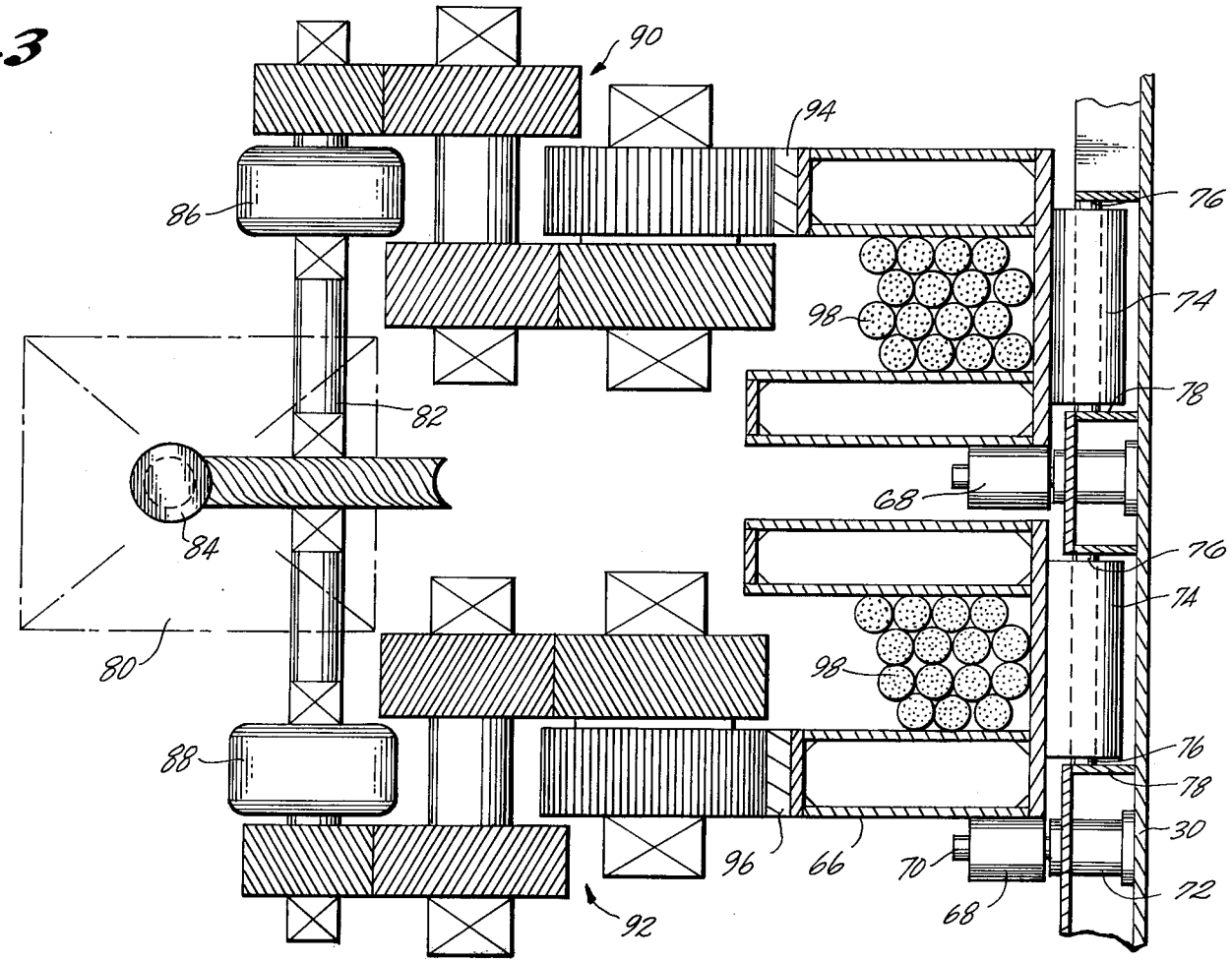
FIG. 3 is an enlarged partial view in section showing details of the cable drum drive.

Each pair of adjacent drums 66 is driven from a common reversible hydraulic drive motor 80 mounted inside the cell. While four motors 80 are located in the cell, only two of these motors are shown in FIG. 1. Each motor 80, as shown in FIG. 3, drives a vertical drive shaft 82 through a suitable worm gear drive 84. The ends of the drive shaft 82 are coupled through clutches 86 and 88 to separate reduction gear drives indicated generally at 90 and 92. The gear drive 90 engages a bull gear 94 extending around the outer perimeter of the upper one of the pair of drums 66 while the gear drive 92 engages a similar bull gear 96 extending around the outer perimeter of the lower of the pair of drums. Four such hydraulic motor and gear drive units selectively rotate any one of the eight drums 66 in either direction about the roll axis.

Each of the drums stores a length of anchor cable, indicated generally at 98. The cable 98 from each drum passes from the drum tangentially outwardly and around and upper sheave 100, there being one such upper sheave 100 for each of the eight drums. Each sheave 100 is positioned such that the top of the sheave is roughly even with the middle of the associated drum; thus the eight sheaves 100 of the embodiment shown in FIGS. 1–4 are located at eight different levels vertically within cell 26. The upper sheaves 100 are supported by suitable brackets 102 secured to the outer wall 28 of the cell. For clarity only one such mounting bracket is shown in FIG. 1. After passing around the upper sheave 100, each cable 98 extends downwardly through the interior space of the cell, passing through a tubular guide 103 (FIG. 2) through the inner bottom wall 36 to a lower sheave 104. The lower sheaves 104 have a portion of their perimeter extending through slots in the bottom 34 of the cell. Thus the cable 98 is directed around the lower sheave 104 and extends radially outwardly from the bottom of the vessel to a suitable anchor (not shown) on the ocean floor.

Hydraulic power is provided to the cell 26 for operating the drive units 80. To this end a hydraulic power unit 110 (FIG. 2) mounted in the hull 10 of the vessel is coupled through a hydraulic and electric power and control hose bundle 112 wound on a hydraulic hose storage reel 114 and lead therefrom to the cell. The hose bundle 112 passes around a sheave 116 positioned above the cell from whence the hose bundle is directed into a trough 118 in the top of the cell 26. The hose bundle connects to controls (not shown) within the cell through which power is controlled and distributed to the various drive units 80. While this arrangement does not permit unlimited rotation between the cell and the vessel, it does not permit the cell to rotate relative to the vessel through substantially a full 360° or more; in practice, this is more than sufficient.

Figure 4:
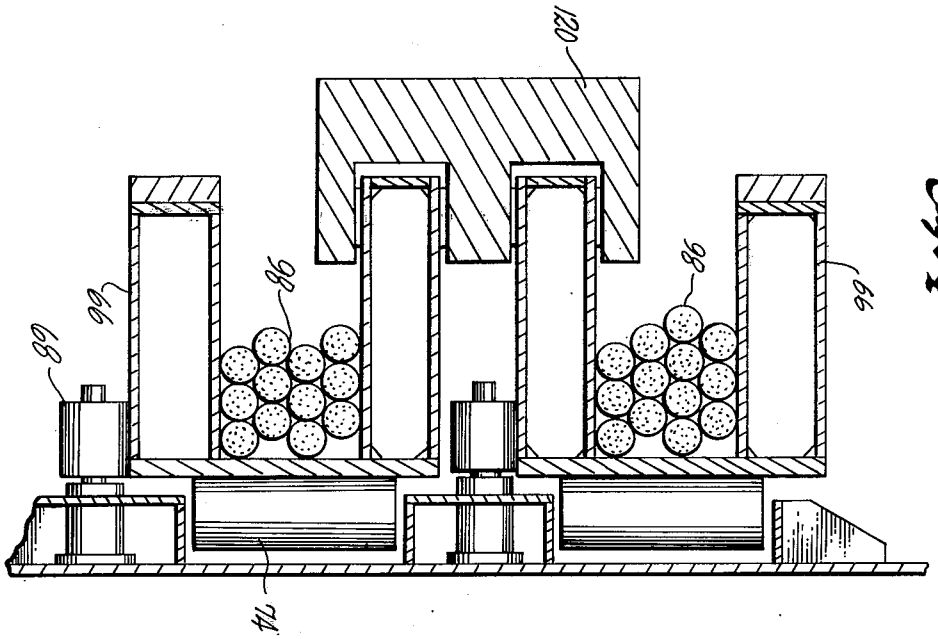
FIG. 4 is a sectional view taken on the line 4—4 of FIG. 1.

As shown in detail in FIG. 4, storage drums 66 are provided with drum braking units 120, each braking unit providing brake control for an associated pair of reels 66. The braking unit includes a pair of brakes of the caliper disc type, which provide braking action by clamping the opposing faces of one flange of the associated drum.

Figure 5:
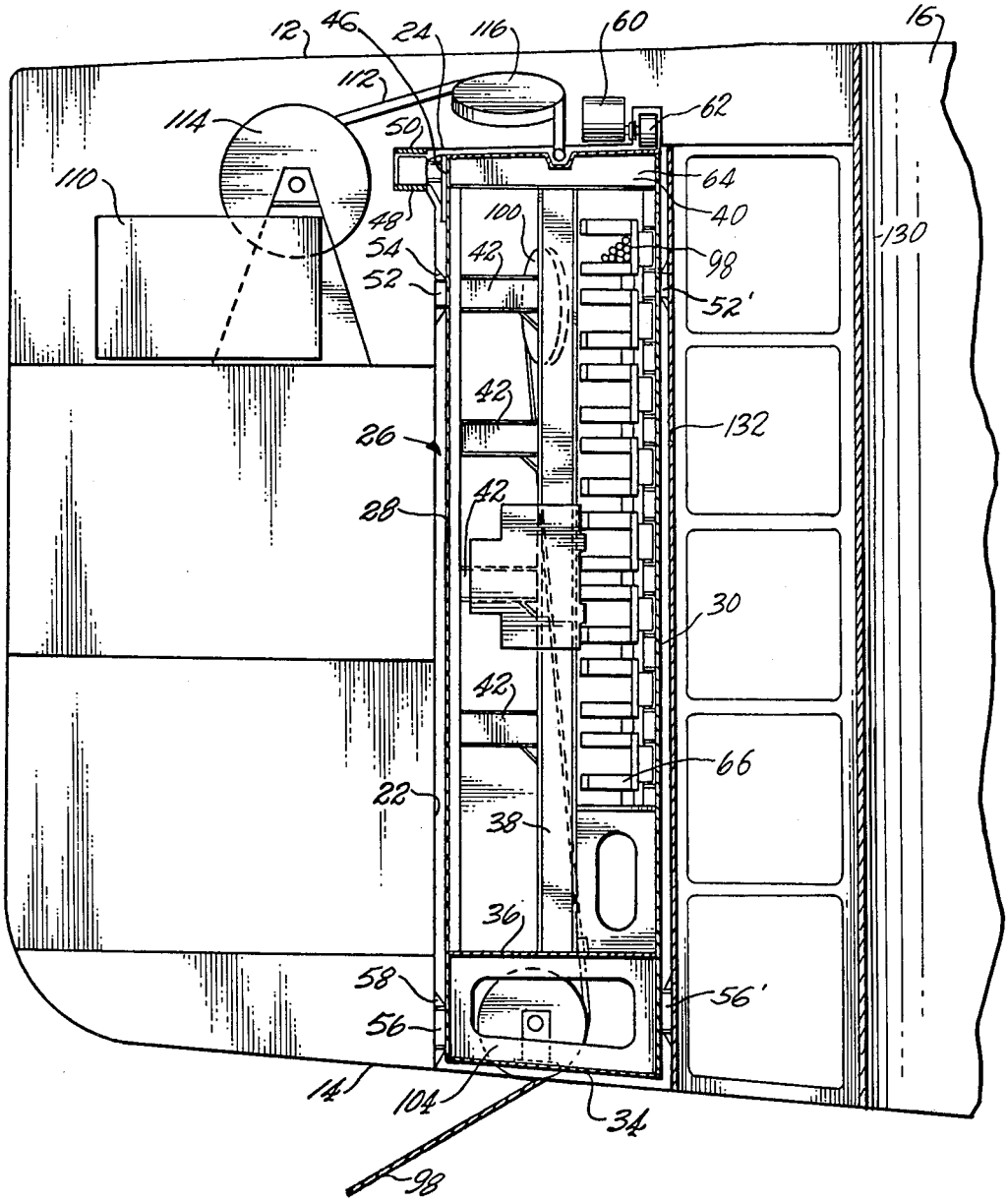
FIG. 5 is a sectional view in elevation of an alternative embodiment of the present invention.

In order that the drums may be made large enough to store the necessary cable, for example, it may be desirable that the annular cell be substantially larger in diameter than the moon pool. Thus the cell may be arranged as shown in the alternative embodiment in FIG. 5. In this arrangement, the cylindrical wall of the moon pool, indicated at 130, is of substantially smaller diameter than the inner wall 30 of the cell. The wall 130 of the moon pool is a fixed part of the hull structure and extends from the opening 16 in the main deck down to the bottom 14, or may terminate at some intermediate level. Concentric with the wall 130 is a second fixed concentric cylindrical wall 132 which extends downwardly from the sub deck 24 to form an annular cavity with the wall 22 in which the annular cell rotates. Additional rollers 52′ and 56′ journal the annular structure for rotation around the cylindrical wall 132. The walls 130 and 132 are joined by suitable bulkheads and cross bracing forming a rigid structure to provide air space within the hull structure. Thus in the arrangement of FIG. 5, the annular cell provides a self-contained mooring system that is entirely separate from, although concentric with the moon pool through which drilling operations take place.

In both the arrangements of FIGS. 1–4 and FIG. 5 it will be noted that the main deck itself is completely free of any equipment or rotating platforms normally associated with turret type mooring systems. Thus the deck is left unobstructed for the mounting of equipment required for or used in drilling operations. Also, the elimination from the main deck in the vicinity of the moon pool greatly simplifies the movement of drilling equipment, such as wellhead landing bases or blowout preventor stacks, to or from the moon pool. A blowout preventer stack is a large and massive piece of equipment which is lowered by the drill string to the submerged drill site at an early stage of the drilling operations, and handling of this piece of equipment is a difficult and potentially hazardous procedure which is not encumbered by the present amidships mooring system. Further, the location of all mooring equipment below the main deck according to this invention lowers the vessel center of gravity thereby enhancing the transverse stability of the vessel, and making possible a lowering of the drilling rig and its center of gravity.

What is claimed is:

1. A mooring system for a drill ship comprising: a hull having a chamber opening to the sea through the bottom of the hull, an annular structure mounted in the chamber, means rotatably supporting the annular structure from the hull for rotation about a vertical axis, a plurality of coaxially aligned rotatable drums having their axes of revolution coaxial with a common vertical axis, means rotatably supporting the drums from the annular structure for independent rotation of each of the drums about said common vertical axis, drive means supported by the annular structure for rotating the drums individually, anchor cables wound on the respective drums, and cable guide means supported on the annular structure and rotatable therewith for guiding the respective cables from the drums through the opening in the bottom of the hull.

2. Apparatus of claim 1 wherein the common axis of rotation of the drums and the axis of rotation of the annular structure are coaxial.

3. Apparatus of claim 2 wherein the drums have aligned central openings providing a vertical passage through the center of the drums, annular structure and the chamber.

4. Apparatus of claim 3 further including drive means mounted on the hull for rotating the annular structure.

5. Apparatus of claim 3 further including brake means mounted on the annular structure and releasably engaging the respective drums for locking the drums against rotation relative to the annular structure.

6. Apparatus of claim 3 wherein the chamber in the hull is annular in shape, the hull including a rigid structure extending through the center of the annular structure, the annular structure being journaled on said right structure.

7. Apparatus of claim 6 wherein the hull has a well extending vertically through the hull through said rigid structure.

8. Apparatus of claim 3 wherein the annular structure includes inner and outer concentric cylindrical walls joined at the upper perimeter by a top wall, the drums being journaled for rotation about the inner wall, the inner, outer and top walls being joined to form an airtight compartment to control the buoyancy of the annular structure.

9. Apparatus of claim 8 wherein the means rotatably supporting the annular structure includes a circular channel-shaped track supported by the hull, and a plurality of horizontal rollers projecting from the outer wall of the annular structure, the rollers extending into the channel of the track to limit the vertical movement of the annular structure relative to the hull while allowing the annular structure to rotate relative to the hull.

* * * * *

UNITED STATES PATENT AND TRADEMARK OFFICE

CERTIFICATE OF CORRECTION

PATENT NO. : 4,064,822

DATED : December 27, 1977

INVENTOR(S) : RUSSELL B. THORNBURG

It is certified that error appears in the above-identified patent and that said Letters Patent are hereby corrected as shown below:

Column 4, line 16, after "does" delete "not".

Column 6, line 8, "right" should read -- rigid --.

Signed and Sealed this

*Eleventh* Day of *April 1978*

[SEAL]

*Attest:*

RUTH C. MASON
*Attesting Officer*

LUTRELLE F. PARKER
*Acting Commissioner of Patents and Trademarks*